US005915559A

United States Patent [19]

Hulick et al.

[11] Patent Number: 5,915,559

[45] **Date of Patent: *Jun. 29, 1999**

[54] SLIDING BLISTER PACKAGE

[75] Inventors: Martin E. Hulick, Warrington; Debbie J. McQuiston, Conshohocken, both of Pa.

[73] Assignee: Sharp Corporation, Inc., Conshohocken, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/800,540

[22] Filed: Feb. 18, 1997

[51] Int. Cl.[6] ..... B65D 83/00

[52] U.S. Cl. ..... 206/536; 206/538; 206/468

[58] Field of Search ..... 206/528, 530, 206/531, 532, 538, 539, 468, 536

[56] References Cited

U.S. PATENT DOCUMENTS

| | | | |
|---|---|---|---|
| 3,157,280 | 11/1964 | Perdue et al. | 206/468 |
| 3,182,789 | 5/1965 | Sparks | 206/536 |
| 3,397,671 | 8/1968 | Hartman, Jr. et al. | 206/539 |
| 4,535,890 | 8/1985 | Artusi | 206/539 X |
| 4,884,693 | 12/1989 | Brutsch | 206/538 |

*Primary Examiner*—Jacob K. Ackun

*Attorney, Agent, or Firm*—Woodcock Washburn Kurtz Mackiewicz & Norris LLP

[57] ABSTRACT

A medicament package for dispensing a medicament and storing an unused portion of the medicament is provided. The package has at least one panel, which has at least one whole medicament compartment and a storage blister. The storage blister is movably coupled to the panel so that it can slide from a first position and a second position. The storage blister is used to receive and dispense the unused portion of the medicament when in the first position, and store the unused portion of the medicament when in the second position.

10 Claims, 3 Drawing Sheets

SLIDING BLISTER PACKAGE

FIELD OF THE INVENTION

The present invention relates generally to blister packages for enclosing medicaments or tablets, and more particularly to blister packages that dispense a whole medicament and store an unused portion of the medicament for later use.

BACKGROUND OF THE INVENTION

Blister packages for containing three dimensional items are well known in the art. These packages may be hermetically sealed to enclose various dosages of aspirin tablets, vitamin tablets, other medicaments, and the like. Traditional blister packages, however, have several drawbacks.

One drawback with traditional blister packages is that an individual blister may contain a higher dosage than is required by a consumer. In this case, the consumer may use only that portion of the medicament that represents the correct dosage, but then discard the unused portion of the medicament. The continued practice of discarding unused portions of the medicament becomes costly to the consumer. It would, therefore, be desirable to provide a package that enables a consumer to take the required dosage of a medicament and then easily store the unused portion for later use.

Almost every type of package that contains a medicament of the kind described above provides a separate informational sheet regarding the product contained within the package. The informational sheet, however, is often discarded after the first use of the product and, thereafter, cannot be referred to when necessary. It would, therefore, be desirable to provide a blister package that enables the user to retain the directions for later reference.

Many blister packages have instructional information printed on the packaging itself. These blister packages, however, do not possess enough space on which all relevant information can be transcribed regarding the product for the consumer to refer to. It would, therefore, be desirable to provide a blister package that contains all relevant information regarding the product contained within the blister package to which consumers may refer.

A consumer may be required to maintain a record of the dosages consumed or when dosages are taken. In these cases, the user may have to keep a written log that is separate from the package from which the dosage came from. The user may be inconvenienced by having to maintain the separate log or may lose the log. It would, therefore, be desirable to provide a package that enables the user to maintain a written log relating to the usage of the product contained within the package with as little inconvenience as possible.

SUMMARY OF THE INVENTION

A medicament package for dispensing a whole medicament and storing an unused portion of the medicament is provided. The package comprises at least one whole medicament compartment that is provided for storing at least one whole medicament therein. The whole medicament compartment is adapted to dispense the whole medicament contained therein. A storage blister, which is slidably coupled with the whole medicament compartment, is adapted to slide from a first position to a second position. The storage blister is adapted to receive and dispense the unused portion of a medicament at the first position. The storage blister is adapted to store the unused portion of the medicament within the storage blister at the second position for later usage.

BRIEF DESCRIPTION OF THE FIGURES

The present invention is illustrated in connection with the accompanying drawing in which.

DETAILED DESCRIPTION OF THE PREFERRED EMBODIMENT

Figure 1:
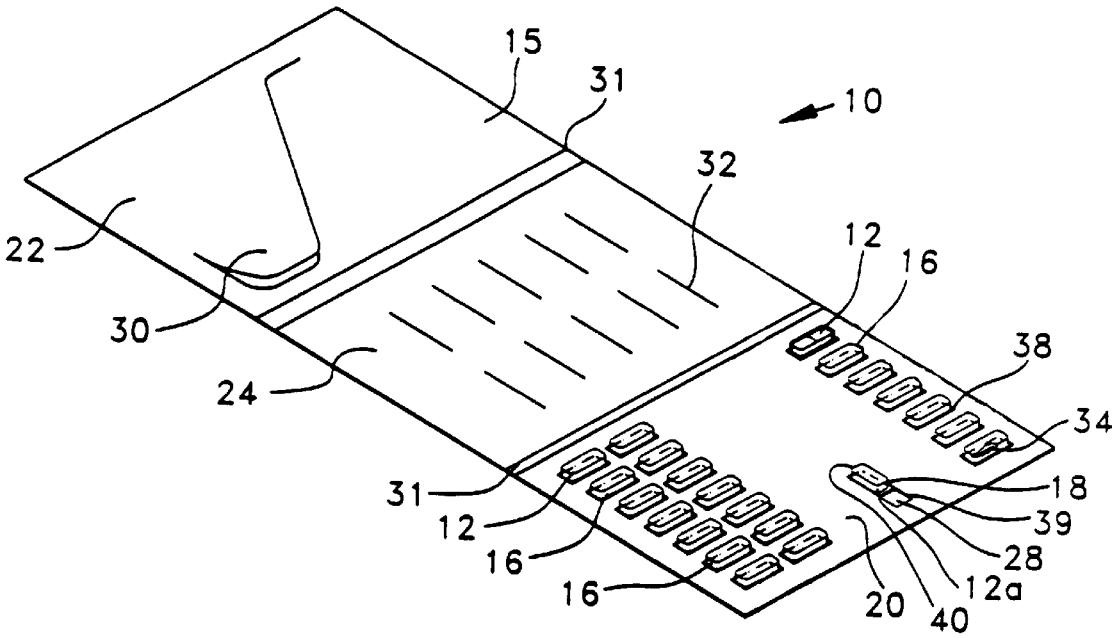
FIG. 1 is a perspective view of a dispensing and storage package in accordance with the present invention.

Referring now to the drawings, the present invention will be described. It is noted that like components are referred to by like reference notation.

FIG. 1 shows the preferred embodiment of a medicament package 10 for dispensing a whole medicament 12 and storing an unused portion of the medicament 12*a* for later use. The package 10 comprises a dispensing card 15, a plurality of whole medicament compartments 16, and a storage blister. Twenty-one medicaments 12 are contained within twenty-one individual whole medicament compartments 16 (one medicament 12 is shown) and one unused portion of a medicament 12*a* is shown stored in the storage blister 18.

The dispensing card 15 comprises a first panel 20, second panel 22, and third panel 24. The panels 20, 22 and 24 are preferably integrally coupled to one another and adapted to fold onto one another to form the medicament package 10. The first panel 20 folds over onto the third or middle panel 24. Thereafter, the second panel 22 is folded over onto the first panel 20. In the final folded position, the second panel 22 and third panel 24 form a front and back cover. Preferably, the dispensing card 14 is made of a paper or cardboard material. It is noted that the panels 20, 22, and 24 can be formed to fold in alternative manners to form the medicament package 10.

The first panel 20 is adapted to securely receive the plurality of whole medicament compartments 16 and slidingly receive the storage blister 18. Preferably, the first panel 20 defines a plurality of whole medicament compartment openings 26 for securely receiving the whole medicament compartments 16, and a storage blister opening 28 that is adapted to slidingly receive the storage blister 18. Consequently, each whole medicament compartment 16 is fixed or non-slidable, while the storage blister 18 is adapted to slide. The whole medicament compartment openings 26 are adapted to dispense each of the whole medicaments from each corresponding compartment 16. The storage blister opening 28 is adapted to receive and dispense at least an unused portion of a medicament 12*a*.

The second panel 22 is adapted to receive a booklet or other literature relating to the product contained within the medicament package 10. Preferably, a jacket 30 is formed in the second panel 22 for receiving the booklet or literature. The method of forming the jacket 30 is well known to those skilled in the art.

The third panel 24 is coupled with the first panel 20 and second panel 22 along fold lines 31. Preferably, the third panel 24 is adapted to receive written or printed information relating to the user's consumption of the product contained within the whole medicament compartments 16. Preferably, the third panel 24 is provided with a number of spaces 33 for recording such information.

Each whole medicament compartment 16 is adapted to dispense a whole medicament 12. Each whole medicament compartment 16 defines a dispensing opening 34 for dispensing the medicament 12 from the compartment 16. Preferably, the whole medicament compartments 16 are blisters formed in a plastic sheet of material. Methods of forming the blisters are well known to those skilled in the art.

Each one of the dispensing openings 34 is covered with at least one layer of a lower sheet 38 to store a whole medicament within the whole medicament compartment 16. Preferably, the lower sheet 38 is hermetically coupled to the whole medicament compartment 16. The lower sheet 38 is adapted to expose the dispensing opening 34 to dispense the whole medicament 12 from the compartment 16. Preferably, the lower sheet 38 is made from a tearable foil material such that the foil can be torn to expose the dispensing opening 34 to dispense the whole medicament 12 from the compartments 16. The lower sheet 36 can also define tear perforations, score lines, and the like, that are detachable to expose each dispensing opening 34.

Methods of hermetically coupling the lower sheet 38 below the whole medicament compartments 16 are well known by those skilled in the art. It is noted that additional sheets of material may be provided over the lower sheet 38 for child-resistance, aesthetic or labeling purposes.

The storage blister 18 is slidably positioned within the storage blister opening 28 such that the storage blister can slide from a first position 39 to a second position 40, as shown in FIG. 1. When the storage blister 18 is at the first position 39, at least one unused portion 12*a* of a medicament 12 can be inserted into and dispensed from the storage blister 18. When the storage blister 18 is at the second position 40, the contents within the storage blister 18 are stored for later use. Preferably, the storage blister is made from a plastic material. The positioning of the storage blister 18 within the package 10 and how the unused portion 12*a* of the medicament 12 is contained within the blister 18 are described in detail below.

Figure 2:
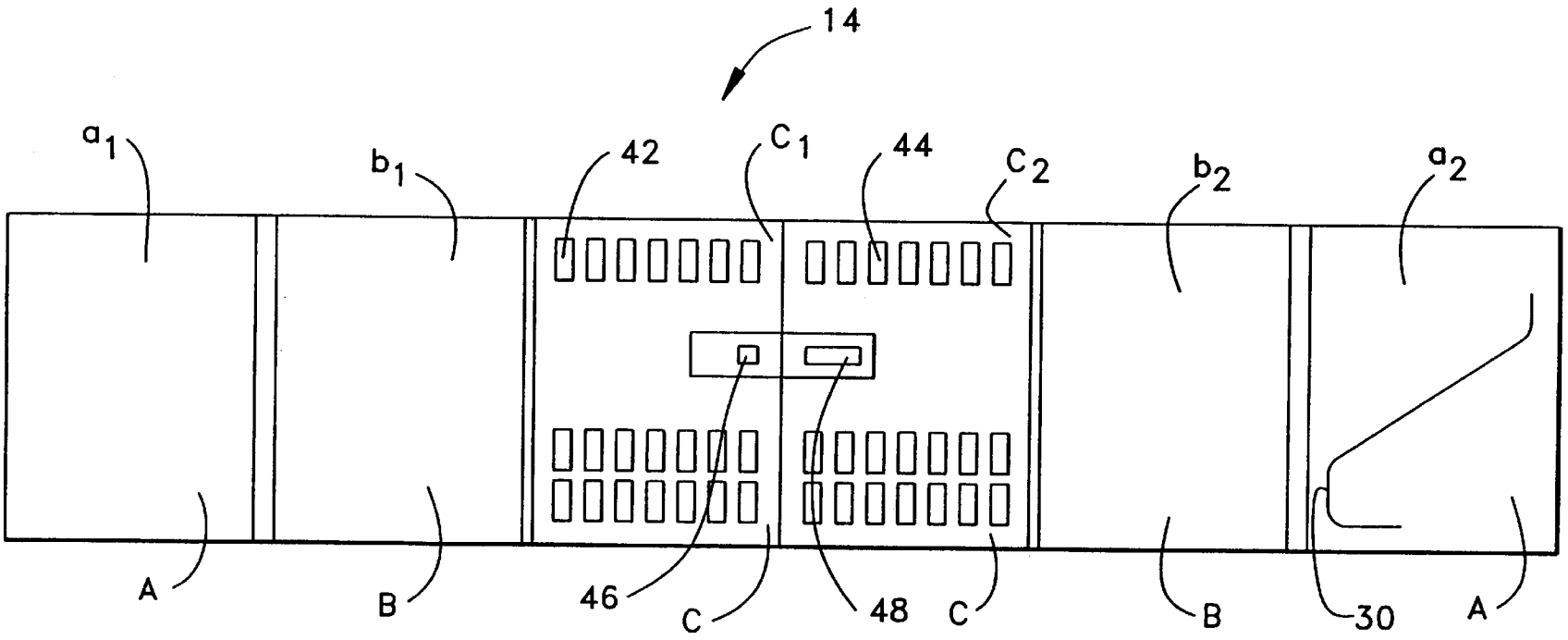
FIG. 2 is a view of the web material formed into the package shown in FIG. 1.

FIG. 2 shows a web 14 of material that is formed into the dispensing card 15. The web 14 comprises three sets of mating panels A, B, and C that form the first 20, second 22, and third 24 panels, respectively, of the dispensing card 10 after the web 14 is folded in half. Panel set A comprises panels $a_1$ and $a_2$, wherein panel $a_2$ defines the jacket 30. Panel set B comprises panels $b_1$ and $b_2$. Panel set C comprises panels $c_1$ and $c_2$ which are both adapted to securely receive the whole medicament compartments 16 and storage blister 18 after the web 14 is folded in half.

Preferably, panels $c_1$ and $c_2$ define openings 42 and 44, respectively, that are substantially concentrically aligned after the web 14 is folded in half to form the whole medicament dispensing openings 38. Each one of the openings 42 in $c_1$ is adapted to expose a portion of the lower sheet 36 of a corresponding compartment opening 26 to dispense the whole medicament from a respective compartment 16. Each one of the openings 44 in panel $c_2$ is adapted to receive a corresponding compartment 16 therethrough.

Additionally, panels $c_1$ and $c_2$ define the storage compartment opening 28 (shown in FIG. 3) after the web 14 is folded in half. Preferably, panel $c_1$ is formed with a small slot 46, and panel $c_2$ is formed with a larger elongated slot 48. The small slot 46 and elongated slot 48 are sized and positioned in each respective panel such that the small slot 46 and elongated slot form the storage compartment opening 28 with offset centers after the web 14 is folded in half. The small slot 46 is adapted to enable at least one whole medicament 12 or unused portion 12*a* of a medicament to pass into and out of the storage blister 18 when the storage blister 18 is at the first position 39. The small slot 46 and elongated slot 48 are described in more detail below.

Preferably, the whole medicament compartments 16 are placed between panels $c_1$ and $c_2$ such that after the web 14 is folded in half, the compartments 16 are positioned through the openings 44 and a portion of the lower sheet 38 is exposed along the openings 42. The folded web 14 is securely sealed, preferably heat sealed, to form the dispensing package 10.

Figure 3:
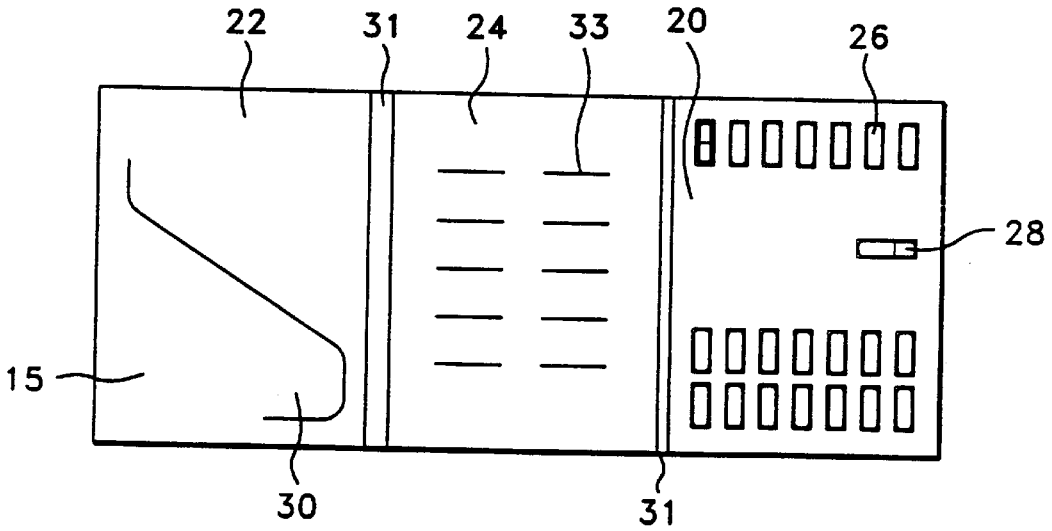
FIG. 3 is a view of the dispensing card shown in FIG. 1 without the whole medicament compartments and storage blister mounted therein.

FIG. 3 shows the dispensing card 14 without the whole medicament compartments 16 or storage blister 18 secured therein to illustrate the positioning of the storage blister opening 28 in more detail. The small slot 46 is formed to cover the storage blister dispensing opening 28 at the second position 40. The small slot 46 also enables the medicament 12 or unused portion 12*a* of a medicament 34 to pass when the storage blister 18 is at the first position 39. The elongated slot 48 is formed to enable the storage blister 18 to slide from the first position 39 to exposed the small slot 46 and then to the second position 40 to close off the storage blister opening 28.

Figure 4:
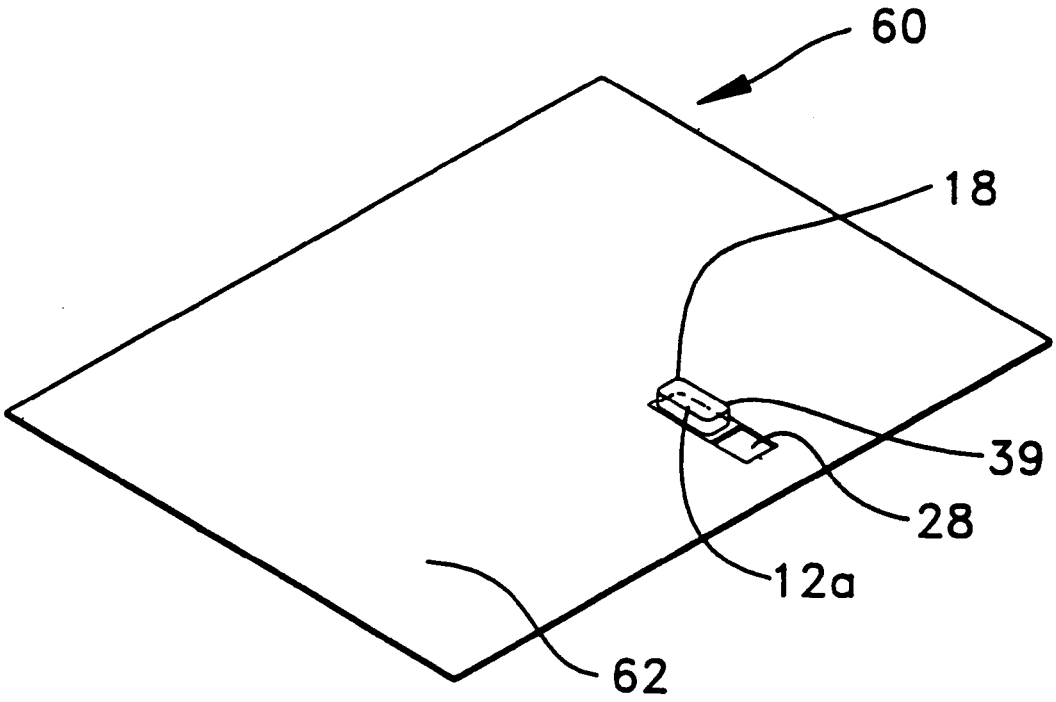
FIG. 4 is a view of an alternative package in accordance with the present invention.

FIG. 4 shows an alternative embodiment of a storage package 60 in accordance with the present invention. The storage package 60 comprises a storage panel 62 and sliding storage blister 18. Preferably, the storage panel is made of a paper or cardboard material. The storage panel 62 defines a storage blister opening 28 which is adapted to slidably receive the storage blister 18. The storage blister opening 28 can be formed in the storage panel 62 in the same manner as in the first panel 20 of the medicament package 10 discussed above. The storage panel 62, however, is formed without medicament compartment openings 26.

Once the storage blister 18 is positioned within the opening 28, the storage blister 18 is adapted to slide from a first position 39 to receive and dispense at least an unused portion of a medicament and slide to a second position 40 to store the unused portion 12*a* of the medicament 12 at the second position 40.

The storage panel 60 can be separately packaged with almost any type of medicament container or blister package. The user can then consume that portion of the medicament 12 needed and then store the unused portion 12*a* of the medicament 12 in the storage panel 60. Subsequently, the storage panel 60 can be carried or stored separate from the medicament container or package.

In operation, a user unfolds the dispensing card 10 panels 20, 22, and 24 to expose the compartments 16. A portion of the lower sheet 33 is torn to expose a compartment dispensing opening 34 and dispense the whole medicament 12. The medicament 12 is divided into the appropriate dosage and consumed by the user, with the remaining unused portion 12*a* of the medicament ready for storage in the storage blister 18. The user then slides the storage blister 18 to the first position 39 to insert the unused portion 12*a* of the medicament through the storage blister opening 28 formed in the first panel 20 and into the storage blister 18. The storage blister 18 is then moved to the second position 40 to store the unused portion 12*a* of the medicament 12 until later needed. The unused portion 12*a* of the medicament 12 is then dispensed from the storage blister 18 by sliding the storage blister 18 back to the first position 40 to dispense the unused portion 12*a* of the medicament 12 through the storage blister opening 28.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A medicament package comprising:

a non-slidable whole medicament compartment comprising a whole medicament blister and adapted to store and dispense at least one whole medicament; and a storage blister adapted to slide from a first position to a second position and further adapted to receive and dispense an unused portion of the medicament when in said first position, said storage blister adapted to store the unused portion of the medicament within the storage blister when in said second position for later usage.

2. The medicament package in claim 1, wherein said whole medicament compartment further comprises a lower foil sheet for containing the whole medicament within the whole medicament blister, said whole medicament blister being plastic and said lower foil sheet adapted to form a dispensing opening for dispensing the whole medicament contained therein.

3. The medicament package in claim 1, further comprising a panel, said panel adapted to securely receive said whole medicament compartment, said panel further adapted to slidably receive said storage blister.

4. The medicament package in claim 3, wherein said panel defines a first panel and the medicament package further comprises a second panel for containing literature relating to the product contained within the whole medicament compartment.

5. A medicament package for dispensing a whole medicament and storing an unused portion of the medicament, said package comprising:

a non-slidable whole medicament compartment, comprising a whole medicament blister for storing at least one whole medicament, said whole medicament compartment securely coupled with a panel, said whole medicament compartment adapted to store and dispense at least one whole medicament contained therein; and a storage blister for storing the unused portion of the medicament, said storage blister slidably coupled with said panel to slide from a first position to a second position, said storage blister adapted to receive and dispense the unused portion of the medicament when in said first position and securely store the unused portion of the medicament when in said second position.

6. The medicament package in claim 5, wherein said whole medicament compartment further comprises a lower foil sheet for containing the whole medicament within the whole medicament blister, the whole medicament blister being plastic and said lower foil sheet adapted to form a dispensing opening for dispensing the whole medicament contained therein.

7. The medicament package in claim 5, further comprising a literature jacket for containing literature relating to the products contained within the whole medicament compartment.

8. A medicament package for dispensing a medicament and storing an unused portion of the medicament, said package comprising:

a dispensing card;

a plurality of non-slidable whole medicament compartments, each comprising a whole medicament blister, for containing and dispensing a plurality of whole medicaments, said plurality of compartments securely coupled to said dispensing card; and a storage blister slidably coupled with said dispensing card, said storage blister adapted to slide from a first position to a second position, said storage blister adapted to receive and dispense the unused portion of a medicament at said first position, and store the unused portion of the medicament at said second position.

9. The medicament package in claim 8, wherein each one of said plurality of whole medicament compartments comprise a lower foil sheet for containing the whole medicament within each one of said whole medicament blisters, the whole medicament blister being plastic and said lower foil sheet adapted to form a dispensing opening proximate each one of the whole medicament blisters for dispensing each one of the whole medicaments contained within each one of said plurality of whole medicament blisters.

10. The medicament package in claim 7, wherein said package is adapted to contain literature relating to the products contained within the whole medicament compartments.

* * * * *